US007595728B2

(12) United States Patent
Wang

(10) Patent No.: US 7,595,728 B2
(45) Date of Patent: Sep. 29, 2009

(54) RF TAGS AFFIXED IN MANUFACTURED ELEMENTS

(75) Inventor: Chih-Hsin Wang, San Jose, CA (US)

(73) Assignee: R828 LLC, Monte Sereno, CA (US)

( * ) Notice: Subject to any disclaimer, the term of this patent is extended or adjusted under 35 U.S.C. 154(b) by 0 days.

(21) Appl. No.: 11/356,584

(22) Filed: Feb. 17, 2006

(65) Prior Publication Data

US 2006/0290504 A1 Dec. 28, 2006

Related U.S. Application Data

(63) Continuation-in-part of application No. 11/168,747, filed on Jun. 28, 2005.

(51) Int. Cl.
*G08B 13/14* (2006.01)

(52) U.S. Cl. ..... 340/572.1; 340/539.26

(58) Field of Classification Search ... 340/572.1–572.7, 340/539.26

See application file for complete search history.

(56) References Cited

U.S. PATENT DOCUMENTS

| | | | | |
|---|---|---|---|---|
| 6,163,299 | A | 12/2000 | Park | |
| 6,373,447 | B1 | 4/2002 | Rostoker et al. | |
| 6,734,825 | B1 | 5/2004 | Guo et al. | |
| 7,245,213 | B1 | 7/2007 | Esterberg et al. | |
| 7,336,270 | B2 | 2/2008 | Sato | |
| 2003/0143971 | A1 | 7/2003 | Hongo et al. | |
| 2004/0185682 | A1 * | 9/2004 | Foulke et al. | 438/800 |
| 2005/0242957 | A1 * | 11/2005 | Lindsay et al. | 340/572.7 |
| 2006/0109120 | A1 | 5/2006 | Burr et al. | |

* cited by examiner

*Primary Examiner*—Daniel Wu
*Assistant Examiner*—Shirley Lu
(74) *Attorney, Agent, or Firm*—Patent Law Group LLP

(57) ABSTRACT

A system for tracking elements employing fixed tags that are permanently attached to elements. The tags include radio-frequency (RF) communication units that are adapted for wireless communication with RF communicators. The RF tags are permanently affixed to elements as part of the manufacturing of products such as cell phones, PDA's, computers, routers and other electronic equipment. The RF tags are installed during manufacturing in a manner that resists tampering and interference. The RF tags are installed with mechanical barriers to access and are hidden from view in non-user accessible locations.

17 Claims, 6 Drawing Sheets

RF TAGS AFFIXED IN MANUFACTURED ELEMENTS

CROSS-REFERENCED APPLICATION

This application is a continuation in part of the application: Ser. No. 11/168,747; Filed: Jun. 28, 2005.

TECHNICAL FIELD

The present invention relates to management systems and to methods and apparatus for tracking electronically tagged elements, such as tagged consumer products, and specifically relates to electronic tags affixed to such elements.

BACKGROUND OF THE INVENTION

Consumer products and other tagged elements are efficiently tracked anywhere in a supply and distribution chain when electronic tags are affixed to the elements. The information content of the tag may be provided by the manufacturer, the distributor, the retailer or any other entity in the supply and distribution chain. Electronic tags are electronically read by electronic readers (communicators) when the tags are within range. For example, electronic tags are read at the point of sale of a product by a tag reader located at a checkout station.

Often electronic tags are affixed to goods in a manner such that the tags are easily seen and accessed by a prospective purchaser of the goods or by others. Also, tags often are not permanently affixed to goods and hence the tags can be removed. For these and other reasons, tampering with electronic tags presents a problem that needs to be addressed.

In retail and other environments, electronic tags are affixed to goods and such affixing often requires a burdensome process whereby each one of the goods needs to be manually handled to affix the tag.

In manufacturing environments, systems are well known for reading tagged elements at different manufacturing stages. The tags are affixed to elements at any stage from an initial stage, through intermediate stages (work-in-process stages) to a final stage. Finished goods are produced as an output from the final stage. In the manufacturing of electronic equipment, typically semiconductor devices are processed in a first processing chain and then processed in a second chain to form electronic circuit boards. Thereafter, third and additional processing chains occur to form the final electronic equipment. Such equipment includes cell phones, computers, cameras, routers, televisions, personal data assistants (PDA's) and other electronic devices. While electronic tags have been widely used in manufacturing processes, the tags used in manufacturing processes have not been effectively used in the retail environment.

In light of the foregoing background, there is a need for improved tags and systems for tracking elements using electronic tags.

SUMMARY OF THE INVENTION

The present invention is a system for tracking elements employing fixed tags that are permanently attached to elements. The tags include radio-frequency (RF) communication units that are adapted for wireless communication with RF communicators.

The RF tags are permanently affixed to elements as part of the manufacturing of products such as cell phones, PDA's, computers, routers and other electronic equipment or other goods of any kind. The RF tags are installed during manufacturing in a manner that resists tampering and interference. In general, the RF tags are installed with mechanical barriers to access and are hidden from view in non-user accessible locations. For example, tags are located in non-user accessible chambers, are imbedded in product cases or are formed as part of semiconductor parts.

In embodiments of the present invention, the RF tags are provided in semiconductor dies and are manufactured with electronic circuits to manufacture the primary functional circuits on the dies. In another embodiment, the RF die tags are manufactured with an external process technology and the tags are then attached to the dies using an add-on process. In either of the embodiments, the RF die tags are bound to the dies and remain with the dies.

In typical embodiments, each RF tag includes an RF coupling element (antenna), an RF interface for transforming signals between RF frequencies and data processing frequencies, memory for storing data, a logic controller for controlling the read/write of data and other operations of the tag and a power supply for powering the tag. Typically, the power supply powers the tag from received energy from incoming RF signals from an RF communicator. The wireless communications between the RF tags and the RF communicators operate with a tag communication protocol.

The foregoing and other objects, features and advantages of the invention will be apparent from the following detailed description in conjunction with the drawings.

DETAILED DESCRIPTION

Figure 1:
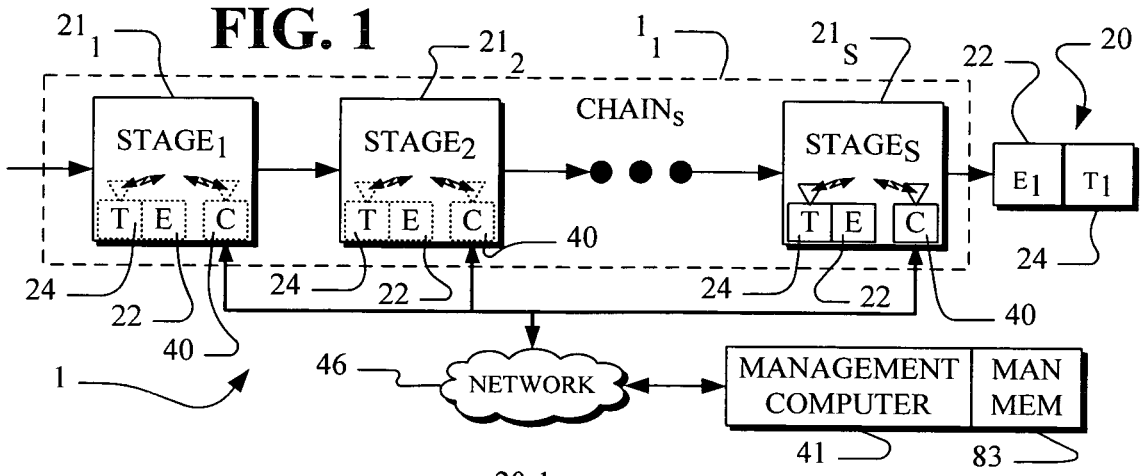
FIG. 1 depicts a chain of stages for processing elements where RF tags are bound to elements to communicate with communicators.

In FIG. 1, a system 1 includes a chain $\mathbf{1}_1$ that operates to process elements 22 through multiple stages 21 including stages $\mathbf{21}_1, \mathbf{21}_2, \ldots, \mathbf{21}_S$. The initial inputs to initial stage $\mathbf{21}_1$ are processed as elements 22 through stages 21 until output element appears at the final stage $\mathbf{21}_S$. In one of the stages 21, an RF tag 24 is affixed to the element 22 so, at least by the final stage $\mathbf{21}_S$, a tag 24 is bound to element 22 forming a tagged element 20. Typically, one or more stages may include an electronic communicator 40 for electronic communication with a tag 24 bound to the processed element 22. Typically, the communication between a tag 24 and a communicator 40 in stages 21 is wireless RF communication. In some embodiments, the communicators 40 each connect through a network 46 to a management computer 41 where the network connections may be of any type such as local area networks (LANs), wide area networks (WANs), the internet and any combination of networks of different types. In some embodiments, one or more or all of the stages 21 have no communicators 40 and function to produce a tagged element 20 including an element 22 and a tag 24.

In FIG. 1, chain $\mathbf{1}_1$ is typical of chains of many different types. For one example, chain $\mathbf{1}_1$ is a first chain in the manufacturing of electronic equipment in which packaged semiconductor devices are manufactured as the elements. In another example, chain $\mathbf{1}_1$ is for manufacture of electronic circuit boards as the elements. In a still further example, chain $\mathbf{1}_1$ is for electronic circuit boards used to form final electronic equipment as the elements. The final electronic equipment is, for example, cell phones, computers, cameras, routers, televisions PDA's and other devices. Regardless as to any particular type of chain or any particular type element produced, an element 22 is manufactured with an affixed tag 24 to form a tagged element 20.

Figure 2:
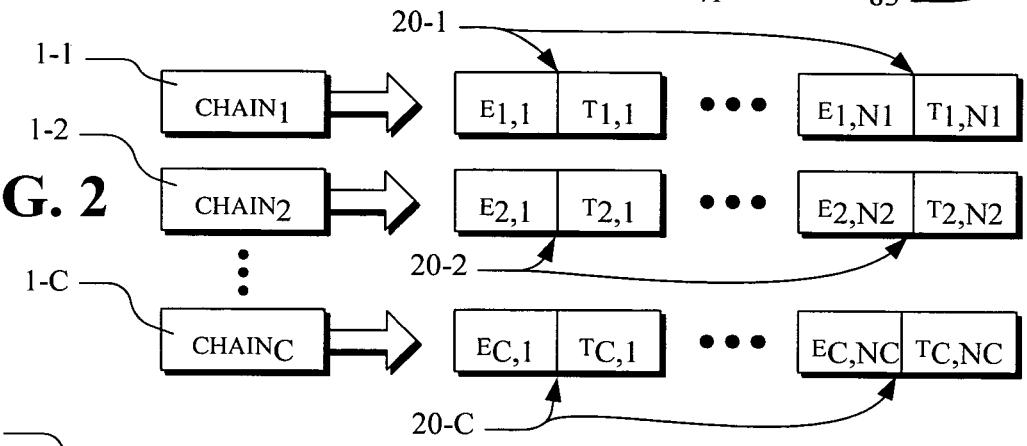
FIG. 2 depicts a group of chains of the FIG. 1 type where RF tags are bound to elements in each of the chains.

In FIG. 2, a plurality of chains 1-1, 1-2, . . . , 1-C like chain $\mathbf{1}_1$ of FIG. 1 are shown. Each of the chains 1-1, 1-2, . . . , 1-C produces tagged elements 20. Specifically, chain 1-1 produces the tagged elements 20-1 including elements $E_{1,1}, E_{1,2}, E_{1,3}, \ldots, E_{1,N1}$ (not all shown). Specifically, chain 1-2 produces the tagged elements 20-2 including elements $E_{2,1}, E_{2,2}, \ldots, E_{2,5}, \ldots, E_{2,N2}$ (not all shown). Specifically, chain 1-C produces the tagged elements 20-C including elements $E_{C,1}, E_{C,2}, \ldots, E_{C,9}, \ldots, E_{C,NC}$ (not all shown). The tagged elements 20 may be any products such as cell phones, computers, cameras, routers, televisions PDA's and other products of all kinds.

Figure 3:
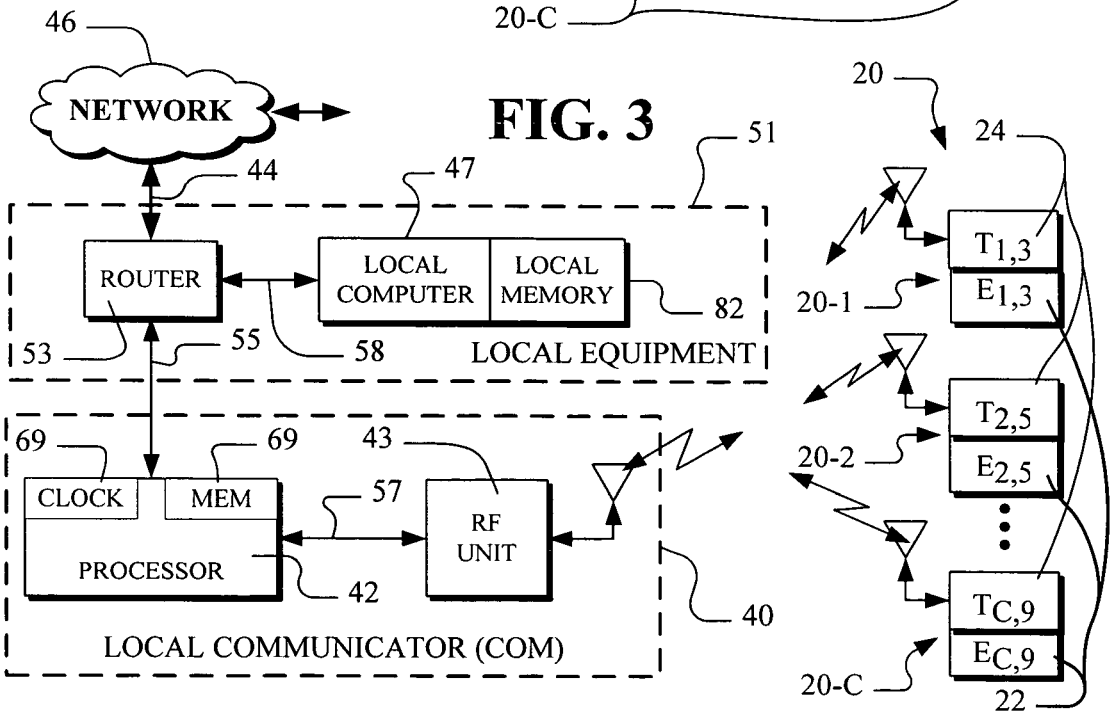
FIG. 3 depicts a typical RF communicator for RF communication with RF tags and for communication over a network to a management computer.

In FIG. 3, the communicator 40 (interrogator, reader, writer) communicates with RF tags 24 bound to elements 22 of tagged elements 20. The tagged elements 20 including tagged elements 20-1, 20-2, . . . , 20-C of FIG. 3 are any ones of the tagged elements of the FIG. 2 chains or any other chains that produce tagged elements. In one particular example, the tagged element 20-1 includes element $E_{1,3}$ and tag $T_{1,3}$ where tagged element 20-1 is for example a TV set, the tagged element 20-2 includes element $E_{2,5}$ and tag $T_{2,5}$ where the tagged element 20-2 is for example a cell phone and where the tagged element 20-C includes element $E_{C,9}$ and tag $T_{C,9}$ where the tagged element 20-C is for example a computer.

In FIG. 3, the communicator 40 includes an RF unit 43 for wireless communication with the RF tags 24. The RF unit 43 communicates with processor 42 over link 57. The communicator 40 communicates with RF tags 24, where the tags 24 are of the type affixed to elements 22 as described. The processor 42 controls the transfer of information to and from the tags 24. The tags 24 respond to tag instructions that pass through the RF unit 43 and that are issued by the processor 42. Processor 42, in one embodiment, stores and executes tag program routines that issue commands that write to, read from and otherwise access tags 24 where the routines typically use an Instruction Set.

The processor 42 in some embodiments is integrated with the RF unit 43 as a single piece of equipment and in other embodiments the RF unit 43 and processor 42 are separated and are connected by a wired or wireless link 57. When separate, typically the connection between RF unit 43 and processor 42 operates according to a wireless WiFi 802.11 a/b/g standard, but any convenient communications link and protocol can be employed.

In FIG. 3, the local equipment 51 may be implemented in different ways. Since each location can be different, the local equipment 51 can differ from location to location to meet the needs of each particular location. The computer 47 in one embodiment connects over a link 58 to a router 53 to enable communication throughout the system, for example to the management computer 41 of FIG. 1. The local computer 47 is optional but typically is provided with conventional hardware elements such as local memory 82, displays, keyboards, interfaces and communications connections (not all shown). The local memory 82 is available for storing copies of information stored in the tags 24. The router 53 interconnects processor 42, network 46 and local computer 47. A connection link 44 connects the router 53 to the network 46 which connects to the management computer 41, including management memory 83 of FIG. 1. The network 46 typically includes a connection over the internet.

In FIG. 3, the system architecture of the local equipment 51 may be of many forms apparent to those skilled in the art of system architecture. For example, the links 44, 55, 57 and 58 may be wired or wireless according to conventional practices. When the connections are wireless, a wireless WiFi 802.11 a/b/g standard is typical, but any convenient communications link and protocol may be employed.

In one embodiment, the processor 42 includes stored programs using a communicator Instruction Set that controls communications through the RF unit 43 and that implements a tag communication protocol for communications with tags 24. The wireless tags 24 store data, in one example, in data quantities in the range from 1 byte to about 128 kilo bits. The data is stored in the tags 24 at data addresses that are specified by the processor 42 when executing routines using instructions from an Instruction Set. Details of one example of an Instruction Set appear in the cross-referenced application entitled SYSTEM FOR TRACKING ELEMENTS USING TAGS hereby incorporated by reference for teaching the details of tag/communicator communications using programs of instructions. All of and any of the operations of the tags 24 and tag communications with a communicator 40 are defined as "tag operations".

In one typical Instruction Set used for tag operations, the instructions rely on the fundamental operations performable by tags. Tags in a one embodiment have seven fundamental functions, namely READ, WRITE, ERASE, QUIET, TALK, LOCK and KILL.

Figure 4:
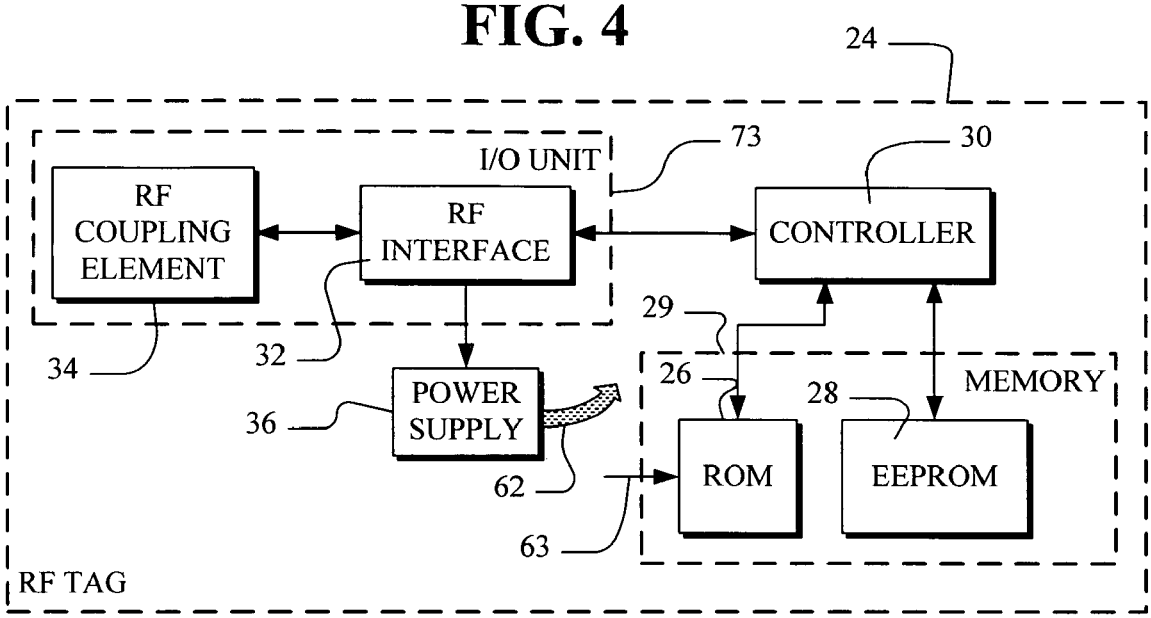
FIG. 4 depicts a typical RF tag of the type affixed to elements.

FIG. 4 shows a functional block diagram of a typical RF tag 24 of the type affixed to elements 22 as described in connection with FIG. 1, FIG. 2 and FIG. 3 and suitable for performing tag operations. The wireless tag 24 includes a memory 29 comprising a read only memory (ROM) 26 and an electrical erasable programmable random access memory (EEPROM) 28, a controller (CONTROLLER) 30, a radio-frequency interface (RF INTERFACE) 32, and a coupling element (RF COUPLING ELEMENT) 34. The RF-interface 32 provides power from the received RF signal to a power supply (POWER SUPPLY) 36 which generates a DC voltage (Vcc) on outputs 62 to power the other components of wireless tag 24. The RF-interface 32 and the coupling element 34 comprise the input/output (I/O) unit 73 for electronic communication with the communicator 40 of the type described in connection with FIG. 3 for processing tag information.

The tag 24 communicates for tag operations with communicator 40 of FIG. 3 through the coupling element 34. The coupling element 34 is typically an antenna of the type having its impedance modulated by signals from RF interface 32. The ROM 26 is typically one-time programmable (OTP) and is used to store permanent data, such as an Element ID. The ROM 26 can be an electrically programmable ROM (EPROM), which permits information to be entered through electrical means, and/or can be a mask ROM, which permits information, be stored through a mask layout during the manufacturing process. When ROM 26 is an electrically programmable device, an enable signal on line 63 allows the controller 30 to address and store data into ROM 26 to initialize the tag 24. The EEPROM 28 is many-times programmable (MTP) and is used to store other types of data (for example, customer number, price and dates). In an alternative embodiment, a portion of EEPROM 28 can be configured to serve the function of ROM 26 and that portion thus configured can be electrically programmed. Each tag typically has an identifier. The identifier typically comprises the Tag ID and a password that are used according to a security protocol for communication with a communicator. The Tag ID and the password each are, for example, any arbitrary or planned sequence of numbers or letters using any coding scheme. Common schemes include binary, ASCII, Extended ASCII, IBM EBCDIC, and hexadecimal, but any scheme whether well known or not may be employed.

Figure 5:
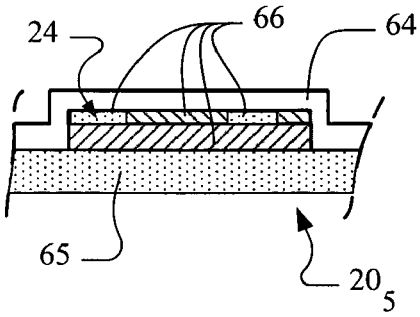
FIG. 5 is a schematic front view representation of tagged element with a tag encapsulated in circuit board material.

In FIG. 5, a schematic front view representation of tagged element $\mathbf{20}_5$ is shown with a tag 24 encapsulated in a circuit structure including a base 65 and an insulating layer 64 where tag 24 includes a multi-region semiconductor chip 66. Typically, tag 24 is formed with semiconductor chip 66 encapsulated into the element $\mathbf{20}_5$ during the normal manufacturing process for the element $\mathbf{20}_5$. Typically the semiconductor chip 66 measures from about 0.2 $mm^2$ to about 1.2 $mm^2$ with a thickness of about 0.1 mm.

Figure 6:
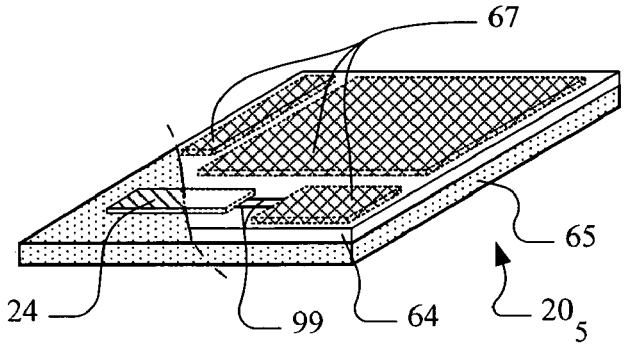
FIG. 6 is a schematic isometric view of the tagged element of FIG. 5.

In FIG. 6, a schematic isometric view representation of tagged element $\mathbf{20}_5$ is shown with the tag 24 affixed and encapsulated on the base 65 by the insulating layer 64. Typically, tagged element $\mathbf{20}_5$ is an element formed of circuit components 67 for providing user functions for a product such as a cell phone, computer, camera, router, television, personal data assistant (PDA) or other electronic device. The circuit components 67 are formed with the base 65 and the insulating layer 64. In FIG. 6, the element semiconductor circuits of circuit components 67 and the tag semiconductor circuits of tag 24 are affixed to a common base 65. In some embodiments, the tag 24 is isolated from the other circuit components 67 whereby the operation of the tag 24 is independent from the operation of the other circuit components 67. In other embodiments, the tag 24 is connected by conductors 99 to the other circuit components 67 to permit interaction between the tag 24 and the other circuit components 67. With such connection of tag 24 and the other circuit components 67, the circuit components 67 and the tag 24 function cooperatively to carry out the tag operations. One example of cooperative interaction to carry out the tag operations occurs where the element is a cell phone and the status of the tag (working/non-working) is recorded in registers in the cell phone. The status of the tag is therefore available over the cell phone network.

Figure 7:
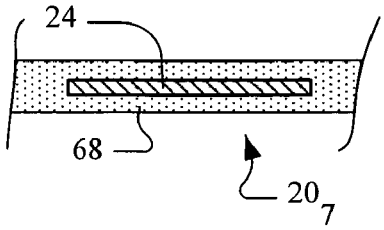
FIG. 7 is a schematic front view representation of tagged element with a tag encapsulated in the material of a case for electronic equipment.

In FIG. 7, a schematic front view representation of tagged element $\mathbf{20}_7$ is shown with a tag 24 encapsulated in an element case 68. Typically, tag 24 is encapsulated into the case 68 during the normal manufacturing process for the element $\mathbf{20}_7$. Typically tag 24 is formed with a semiconductor chip that measures from about 0.2 $mm^2$ to about 1.2 $mm^2$.

Figure 8:
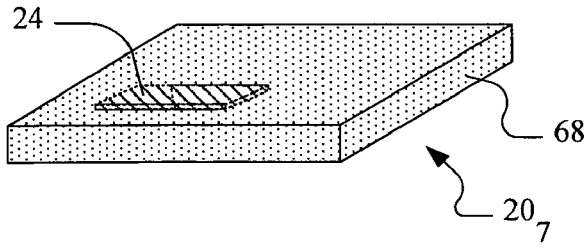
FIG. 8 is a schematic isometric view of the tagged element of FIG. 7.

In FIG. 8, a schematic isometric view representation of a tagged element $\mathbf{20}_7$ is shown with the tag 24 encapsulated in the element case 68. Case 68 is typically formed of plastic or other material of the type commonly used for electronic equipment such as cell phones, computers, cameras, routers, televisions, personal data assistants (PDA's) and other electronic products.

The encapsulation and packaging of the tag 24 in each of FIG. 5, FIG. 6, FIG. 7 and FIG. 8 are designed to cause failure of tag operations if tampering with the tag occurs. Any attempt to tamper with, remove or alter the tag 24 results in the tag failing to operate properly or at all. Any attempt to tamper with, remove or alter the tag 24 causes a failure of the FIG. 4 semiconductor circuits when such circuits are packaged as described in FIG. 5, FIG. 6, FIG. 7 and FIG. 8. The failure of such circuits has been studied extensively as shown by way of typical examples in FIG. 9 and FIG. 10.

Figure 9:
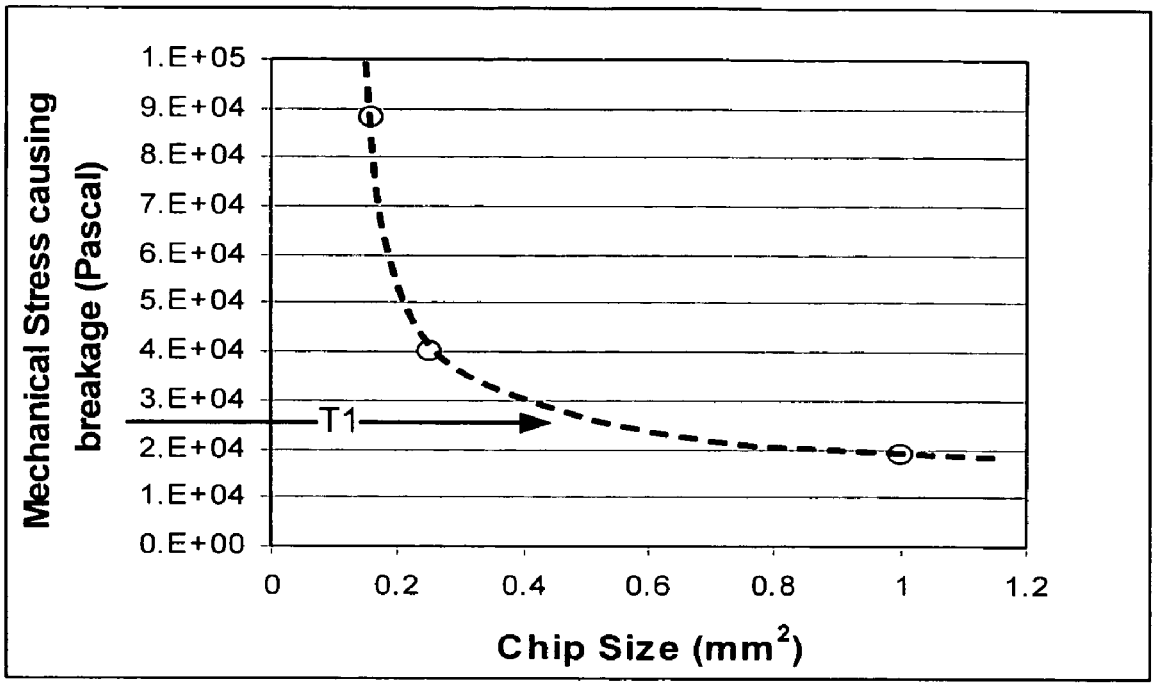
FIG. 9 depicts a graph of breakage of tags as a function of mechanical stress and as a function of chip size.

FIG. 9 depicts a graph of mechanical stress causing breakage for mechanical stress ranging from 0 to $1\times10^5$ Pascal as a function of chip size ranging from 0.2 $mm^2$ to 1.2 $mm^2$. The stress caused by any tampering with a tag 24 in FIG. 5, FIG. 6, FIG. 7 and FIG. 8 readily exceeds the T1 threshold of FIG. 9 that causes the tag to break or otherwise cease tag operation. A tag having a threshold T1 in FIG. 9 has a low threshold for mechanical stress. The tag structures of FIG. 5, FIG. 6, FIG. 7 and FIG. 8 are designed such that any attempt to tamper with, remove or alter the tag 24 will cause the T1 threshold to be exceeded and will result in a failure of the intended tag operation.

Figure 10:
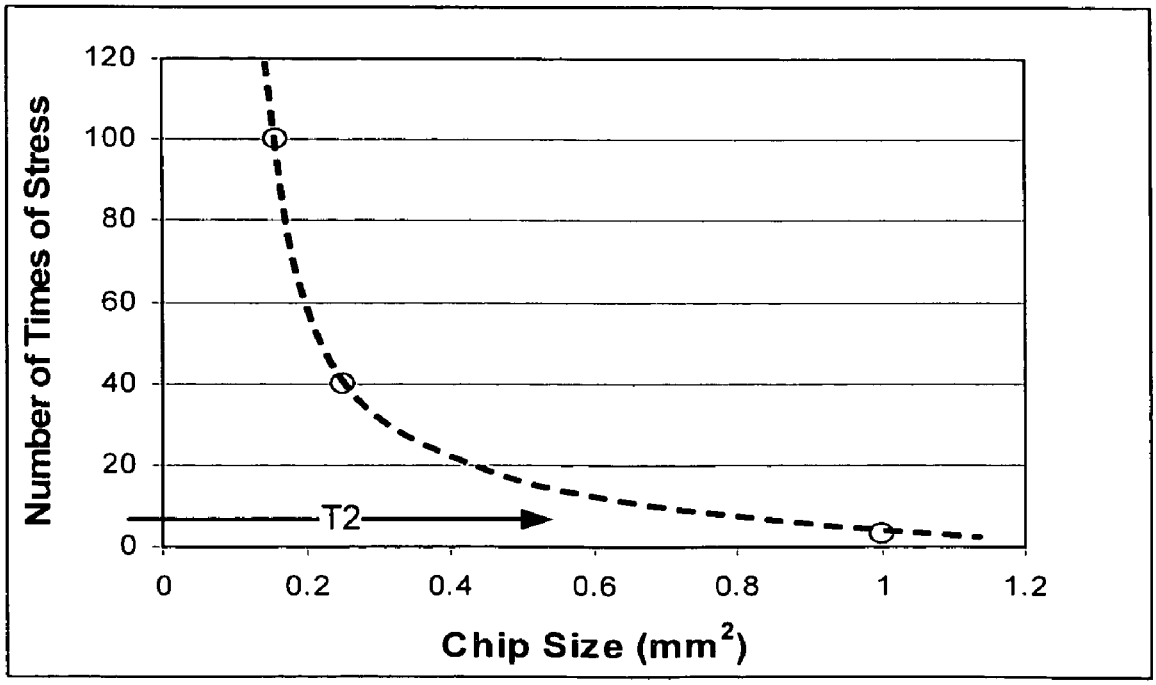
FIG. 10 depicts a graph of breakage as a function of the number of times stress is applied and as a function of chip size.

FIG. 10 depicts a graph of breakage as a function of the number of times stress is applied and as a function of chip size. For chips of about 1 $mm^2$, only one or a very few tampering acts cause the tag 24 in FIG. 5, FIG. 6, FIG. 7 and FIG. 8 to break or otherwise cease tag operation. A tag that breaks or otherwise ceases tag operation when subjected to a threshold T2 of FIG. 10 has a low threshold value of mechanical stress. The tag structures of FIG. 5, FIG. 6, FIG. 7 and FIG. 8 are designed such that any attempt to tamper with, remove or alter a tag 24 will cause the T2 threshold to be exceeded and will result in a failure of the intended tag operation.

Either one of or the combination of both of the mechanical stress thresholds T1 and T2 set and selected in accord with FIG. 9 and FIG. 10, renders a tag 24 tamper proof. In some embodiments, the tags of FIG. 5, FIG. 6, FIG. 7 and FIG. 8 are formed of materials that break with a low value of mechanical stress (materials 64, 65 and 68 for example, with T1 below $3\times10^4$ Pascal or below some other stress threshold selected in FIG. 9 or in any equivalent graph). In some embodiments, the tags of FIG. 5, FIG. 6, FIG. 7 and FIG. 8 are encapsulated by materials (64, 65 and 68) having a low breakage factor as a function of the number of times stressed (for example, with T2 below 5 times or some other stress threshold selected in FIG. 10 or any equivalent graph).

Figure 11:
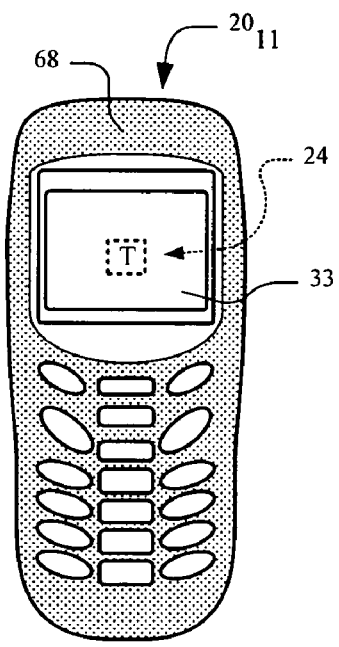
FIG. 11 depicts a front view of a tagged element that is a cell phone.

FIG. 11 depicts an example on a tagged element $\mathbf{20}_{11}$ and is illustrated in the form of a cell phone with an outer case 68, a display 33 and a tag 24. The tag 24 is hidden from view (therefor, shown broken line in FIG. 11) of anyone attempting to tamper with the tag 24. The tag 24 is permanently affixed to and transportable with the tagged element $20_{11}$. Further, tag 24 is affixed and encapsulated under the display 33.

Figure 12:
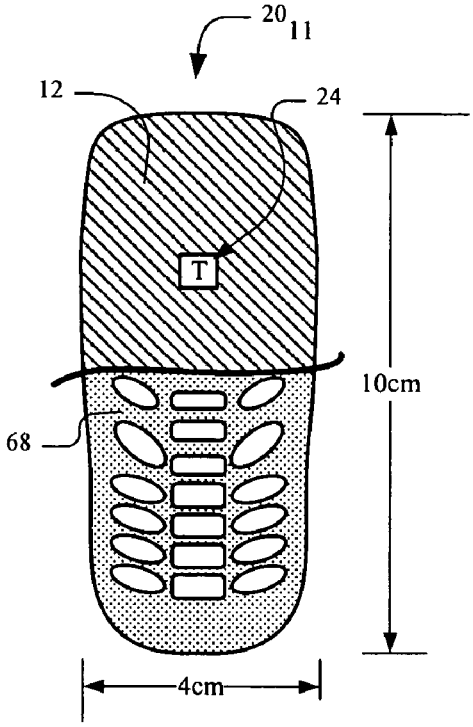
FIG. 12 depicts a partially removed front view of the cell phone of FIG. 11.

FIG. 12 depicts a partially removed front view of the tagged element $20_{11}$ cell phone of FIG. 11 where the display 33 of FIG. 11 has been removed to reveal the tag 24 underneath. The tag 24 in the tagged element $20_{11}$ being affixed under the display 33 is in a non-user accessible location and hence tampering is made difficult.

Figure 13:
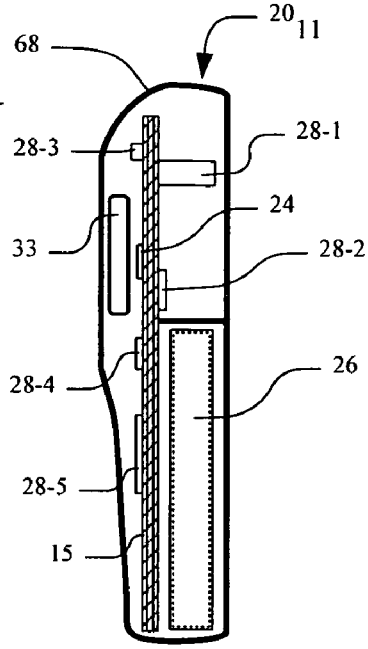
FIG. 13 depicts a sectional side view of the cell phone of FIG. 11.

FIG. 13 depicts a sectional side view of the cell phone tagged element $20_{11}$ of FIG. 11 and FIG. 12. The tag 24 is located and affixed under the display 33 in a location not accessible to a user. Further, the tag 24 is formed of a semiconductor chip device mounted on a circuit board 15 as shown in FIG. 5. The tag 24 has tag semiconductor circuits that provide the tag operations of the tag 24. The circuit board 15 connects a number of components 28-1, 28-2, 28-3, 28-4 and 28-5 having element semiconductor circuits that provide the user functions necessary for cell phone operation of tagged element $20_{11}$. The cell phone is powered by a battery 26. Any tampering to gain access to the tag 24 will damage the tag 24 and render it inoperable and also is likely to damage the cell phone. The tag 24 is designed such that tampering destroys tag operation. The tag 24 is for providing RF communication with a communicator 40 (see FIG. 3) and tag 24 is permanently affixed to and transportable with the tagged element $20_{11}$ and is encapsulated so that tampering destroys tag operation of tag 24. The term "tag operation" means the normal operation of a tag that can occur if no tampering has been attempted. The term "encapsulated" means the packaging, enclosing or other structural environment such that if tampering is attempted normal tag operation will be destroyed. Such normal operation includes RF communication between a tag and a communicator. Typically, if tampering occurs, the ability to RF communicate is destroyed. However, any impeding of the normal operation of a tag is intended to be included within the meaning of "impeding tag operation". For example, tampering may not necessarily defeat RF communication but may provide a logical state (binary 1 or 0) that indicates tampering and thereby causes normal tag operation to be disrupted.

Typically, the tagged element $20_{11}$ of FIG. 13 provides cell phone user functions for the tagged element $20_{11}$. The tagged element $20_{11}$ typically has semiconductor circuits (components 28-1, 28-2, 28-3, 28-4 and 28-5) manufactured with a native semiconductor process to form semiconductor chips on a circuit board 15. The tag 24 provides RF communication with the communicator 40 (see FIG. 3) where the tag 24 is mounted on the circuit board 15 and hence is affixed to and transportable with the tagged element $20_{11}$. Typically, the tag 24 is manufactured with the native semiconductor process used to form the components 28-1, 28-2, 28-3, 28-4 and 28-5 and encapsulated on said circuit board 15 so that any tampering will destroy the tag operation of tag 24. While shown mounted on a circuit board 15, one or more of the components 28-1, 28-2, 28-3, 28-4 and 28-5 can be mounted together with the tag 24 on a common semiconductor substrate. In one preferred embodiment, the semiconductor structure of the tag 24 has the threshold properties of FIG. 9 and FIG. 10.

Alternately, the circuit components and the tagged element $20_{11}$ can be manufactured with other types of technology, including organic semiconductor technology and other types of materials, including plastic semiconductor materials. Organic semiconductor technology uses standard polyester foil as a substrate on which transistors made from an organic semiconductor are printed with insulating plastics. Such organic semiconductor can be polythiophene-based material or any other types of organic material having semiconductor characteristics. For purposes of the present specification, the term "semiconductor" is intended to include silicon, gallium arsenide, organic and other materials having semiconductor characteristics.

Figure 14:
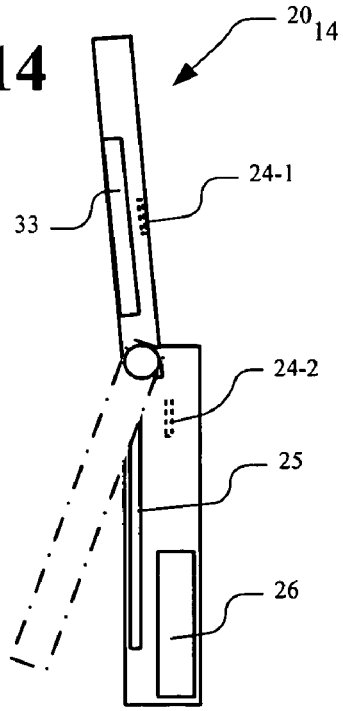
FIG. 14 depicts a sectional side view of another tagged element that is a cell phone.

FIG. 14 depicts a side sectional view of a tagged element $20_{14}$ where element $20_{14}$ is another cell phone. The element $20_{14}$ includes two tags 24 including a first tag 24-1 and a second tag 24-2. The tag 24-1 is located under the display 33 in a location not accessible to a user. Any tampering to gain access to the tag 24-1 is likely to damage the tag 24-1 and render it inoperable and also is likely to damage the cell phone. The cell phone tagged element $20_{14}$ includes the second tag 24-2 which provides redundancy for tag functions. The second tag 24-2 is located under the keyboard 25 in a location not accessible to a user. Each tag 24-1 and 24-2 has a separate address and is independently operable for tag operations and communications with a communicator 40 (see FIG. 3).

Figure 15:
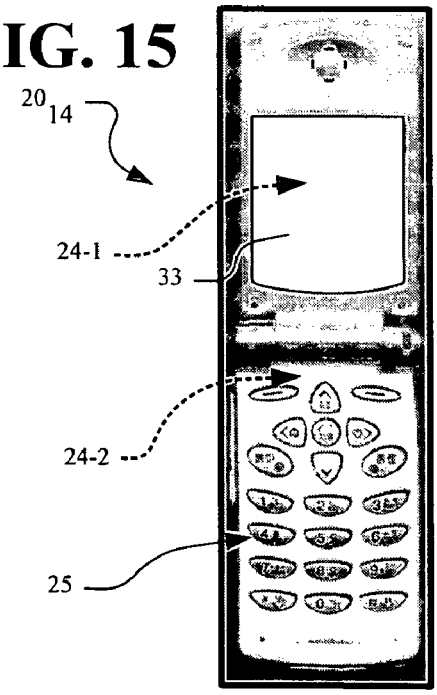
FIG. 15 depicts a front view of the cell phone of FIG. 14.

FIG. 15 depicts a front view of the tagged element $20_{14}$ in the form of the cell phone of FIG. 14 where the presence of the tags 24-1 and 24-2 is hidden and not readily discovered by anyone attempting to tamper. Each of the tags 24-1 and 24-2 is encapsulated in the manner described in connection with FIG. 5, FIG. 6, FIG. 7 and FIG. 8. The tags 24-1 and 24-2 are permanently affixed to and transportable with the tagged element $20_{14}$. Further, the tags 24-1 and 24-2 are affixed and encapsulated under the display 33 and under the keyboard 25.

Figure 16:
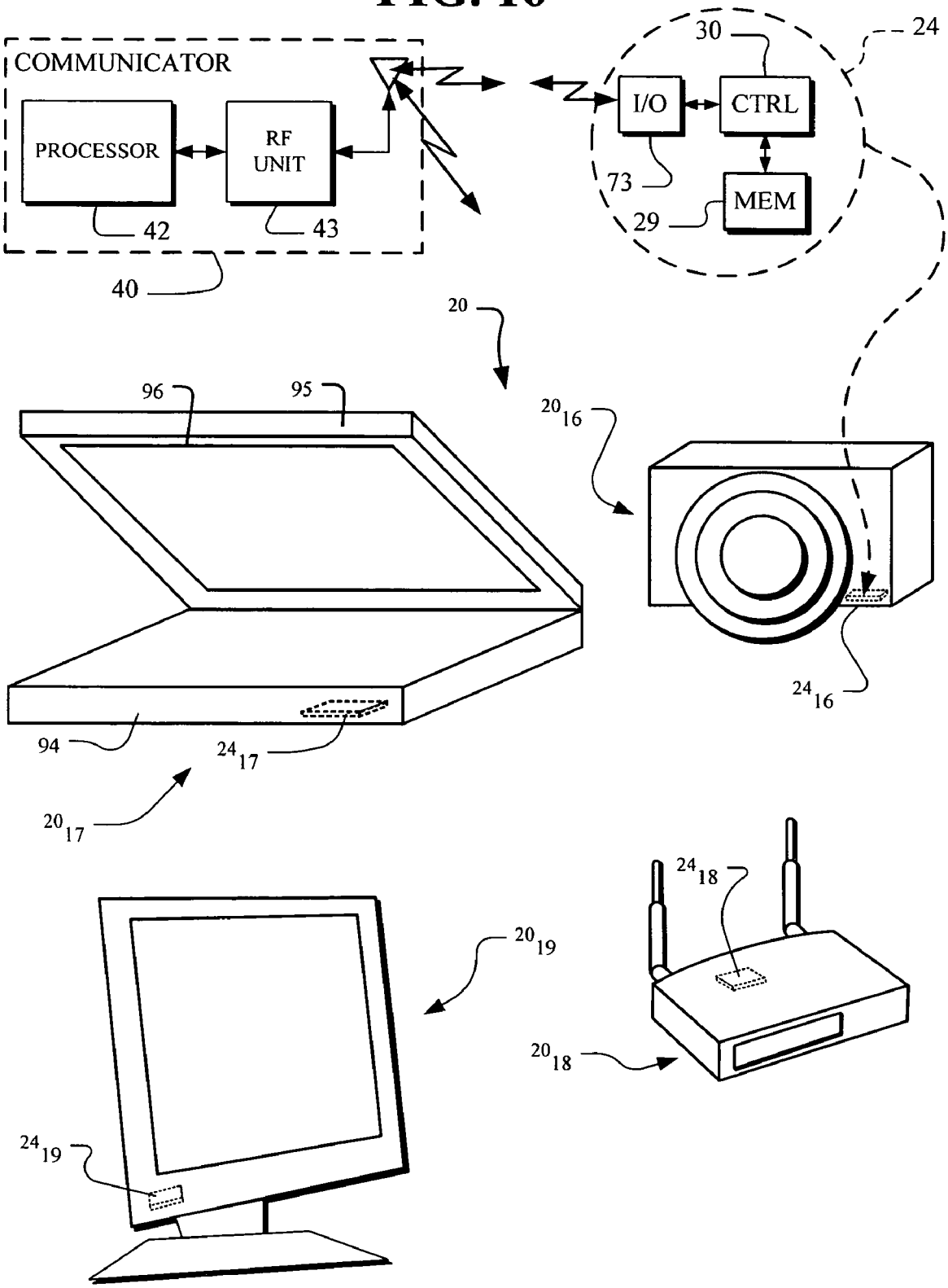
FIG. 16 depicts a view of a plurality of tagged elements including a camera, a portable computer, a router and a display all located within the proximity of a local communicator.

FIG. 16 depicts a view of a plurality of tagged elements 20 including a camera $20_{16}$, a portable computer $20_{17}$, a router $20_{18}$ and a display $20_{19}$ all within the proximity of a communicator 40. The tagged elements are present, for example, in a retail establishment where such elements are offered for sale. The tagged elements $20_{16}$, $20_{17}$, $20_{18}$ and $20_{19}$ include the tags $24_{16}$, $24_{17}$, $24_{18}$ and $24_{19}$, respectively. Each of the tags $24_{16}$, $24_{17}$, $24_{18}$ and $24_{19}$ is affixed to the respective element 20 and encapsulated in the manner described in connection with FIG. 5, FIG. 6, FIG. 7 and FIG. 8 so as to prevent tampering.

The communicator 40 communicates with the tags $24_{16}$, $24_{17}$, $24_{18}$ and $24_{19}$ for tag operations. The tag $24_{16}$ is shown in an exploded view as tag 24 and is representative of each of the tags $24_{16}$, $24_{17}$, $24_{18}$ and $24_{19}$ of FIG. 16. The wireless tag 24 is affixed to and encapsulated in the respective element 20 and is suitable for storage and retrieval of any type of information useful in management, inventory and other systems. Prior to normal tag operations, each tag 24 is initialized to store a Tag ID that uniquely identifies the tag 24 and hence the corresponding tagged element 20.

In one preferred embodiment, the controller 30 of tag 24 executes only the fundamental commands READ, WRITE, ERASE, QUIET, TALK, LOCK and KILL. An Instruction Set using those commands is located in the processor 42 of communicator 40. Sequences of instructions using instructions in the Instruction Set are executed by the processor 42. Each executed instruction in a sequence of instructions causes commands to be issued to the controller 30 which in turn commands the tag operation of one or more of the tags $24_{16}$, $24_{17}$, $24_{18}$ and $24_{19}$. In an alternative embodiment, an Instruction Set interpreter is imbedded in the controller 30. In such an embodiment, the processor 42 issues instructions from a program (routine of instructions) of the Instruction Set directly to controller 30 and controller 30 interprets those instructions in a manner that is the equivalent of executing a series of commands.

The memory 29 in tag 24 operates to read and write data under control of the controller 30. The controller 30 receives communications from the communicator 40. Among other parts, the instructions include address fields that typically include ElementID, Address and Command as well as Data fields. The ElementID field is a unique address of the element to identify, for example, the different tagged elements $\mathbf{20}_{16}$, $\mathbf{20}_{17}$, $\mathbf{20}_{18}$ and $\mathbf{20}_{19}$. The Address field specifies the tag addresses location in the memory 29. The Command field indicates the particular operation (for example, READ or WRITE) to be executed by the controller 30 at the tag address. The Data field supplies or receives data to or from the memory 29.

When any one of the wireless tags 24 of FIG. 16 is not within an interrogation zone of the communicator 40, the tag 24 is passive. When within the interrogation zone, the wireless tag 24 (including any of the tags $\mathbf{24}_{16}$, $\mathbf{24}_{17}$, $\mathbf{24}_{18}$ and $\mathbf{24}_{19}$ of FIG. 16) is commanded to operate by signals transmitted from the communicator 40. To write data, a write command instructs the wireless tag 24 to perform a write operation and data from the communicator 40 is stored into the writable memory of the wireless tag 24. To read data, a read command signal from the communicator 40 instructs the wireless tag 24 to perform a read operation. After the tag 24 receives a read command, the tag 24 sends data read from the memory 29 to the communicator 40. Typically, the tag 24 communication is not directional and the sensing sensitivity typically ranges from −6 dBm to −18 dBm. The sensing speed (including handling of the data carrier) is typically shorter than about 0.1 second or less. The RF tags 24 operate effectively over a range from less than 1 m to about 100 m.

In normal operation after a tag has been initialized, when the tag 24 is in the proximity of an active communicator 40, the power supply 36 (see FIG. 4) energizes the tag 24 to be active for tag operation. The controller 30 receives commands from communicator 40 through I/O 73. Upon receiving a communication, controller 30 operates first to compare the ElementID received with the communication with an ElementID stored in memory 29. If they match, then the tag 24 is enabled to execute the received command. The controller 30 examines the command field of the received communication and then executes the command. In the example described, the command is one of the seven commands READ, WRITE, ERASE, QUIET, TALK, LOCK and KILL used by the instructions from the communicator 40.

Communications between tags and communicators is accomplished by executing sequences of instructions (often called programs or routines) executed by the processor 42 in communicator 40. The routines are stored in the processor memory 69 (see FIG. 3 and FIG. 16). Each routine is a step that is performed one or more times. One example for purposes of illustration is a Time-Store Routine for automatically recording time. The Time-Store Routine includes a sensing step, a time-capture step, and a record step. In the sensing step, a READ Selected instruction is executed when, for example, a group of tags are identified and selected by the communicator 40. In the time-capture step, the time is copied from the clock 69 of the processor 42 of FIG. 3. In the record step, the copied time is written to the selected tags (for example, the tags $\mathbf{24}_{16}$, $\mathbf{24}_{17}$, $\mathbf{24}_{18}$ and $\mathbf{24}_{19}$ of FIG. 16) using the WRITE Selected instruction. In some applications if desired, the time stored on the tags contains minute, hour, date, month, and year information.

Another example of a routine, for purposes of illustration, is a Security routine. In some embodiments, tags operate with security algorithms that require, for example, a password for executing certain commands (such as KILL, LOCK, TALK etc.) called for by instructions in the Instruction Set in order to provide high security. Since the KILL command can permanently deactivate a tag such that the tag will no longer respond to or execute commands from communicators, password security protection is often employed.

One example of a Security routine for KILL instructions operates as follows: When a KILL Address instruction is to kill a tag at the Tag Address specified in the instruction; the instruction also provides a security string. The communicator sends the KILL command, the Tag Address and the security string to the tag. The tag receives the KILL command, the Tag Address and the security string and the controller 30 recognizes that a security check must be performed before executing the KILL command. The tag controller 30 first compares the received security string (typically comprising the Tag ID and a password) from the communicator with its own security string stored in the tag memory. The KILL command will be executed to kill the tag at the specified Tag Address if the security string supplied matches the security string stored. Since the KILL command can permanently deactivate a tag such that the tag will no longer respond to or execute commands from communicators, password security protection is employed. Security routines for other instructions can also be used as a step in any stage, when desired, to operate in an analogous manner.

An Inventory routine is used for determining tags that are within the range of a communicator 40. The Inventory routine can be used as a step at any location and is used to detect newcomers to a location. Any particular location may have a communicator potentially surrounded by only a few elements or by thousands of elements. In order to determine the general population and an inventory of what is present, the Inventory routine is used. At any time, a READ Filtered instruction is used to determine the Tag Addresses of tags that have a predetermined condition. For example, a "Stage Inventory=0" field is established as a default value for tags that have not been inventoried and "Stage Inventory=1" value is stored for tags that have been inventoried. In operation, the Inventory routine is only looking for "Stage Inventory=0" values using the READ Filtered instruction. Normally, therefore, the number of tags responding will be readily within the bandwidth capabilities of the communication protocol. If too many tags have not been inventoried, then additional parameters (such as date and time) may be used to reduce the responding tags. For example, all tags having a date and time of one value (or range) will be selected. Next, a different date/time combination is processed until all relevant dates and times have been processed.

The accessing of information from the tag and other memories described, both content addressing and explicit addressing are possible. For example, when a READ Address or READ Selected instruction is employed, addressing is to locations explicitly identified by Tag Addresses provided in the instruction. However, when a READ Filtered instruction is employed, the addressing is based upon content.

In order to adequately track elements and information, a memory architecture is provided that permits each element to store, to the extent desired, the prior history of the element including prior processing and relationships to prior elements. Furthermore, when multiple elements are grouped to form subsequent new elements of a different type, multiple prior tags from the multiple elements are retained in the new elements and/or the new elements in turn may have new tags for receiving information from the prior tags and/or for storing new information. Regardless as to whether all tags for all elements are retained in subsequent elements, the information content for uniquely identifying all or any desired subset of the processing history can be carried to the final element.

The finished goods from output stages of one or more chains have tagged elements that store element information.

For example, an electronic board element processed in a chain typically includes multiple packaged chip semiconductor devices from multiple prior chains. Each semiconductor device can include one or more tags. Similarly, a board device output from a chain adds a board tag which is in addition to the plurality of device tags. The board tags include, if desired, an accumulation of all or some of the tag information from the device tags Added processing information is added, if desired, at each stage during processing. The finished goods stores final element information for the finished element. The addition of multiple tags and the multistage processing as described results in a hierarchy of tags and information through multiple processing stages. The multiple tags in any stage may be accessed or inhibited from being accessed under security conditions and using protocols available at different communicators. The final tag information may be as complex or as simple as desired.

In one example, tags are locked by instructions at the final goods stage of any chain. When tags are locked, they are not readable without first being unlocked. Locked tags from a prior stage need to be unlocked before use at a subsequent stage and in order to be unlocked, proper authorization is required. Further, the tags from any stage may be KILLED for permanently preventing tag information from being accessed.

After LOCK, typically, the storage information from prior stages is not readable by a communicator. In the situation where there is a need for accessing locked tags (such as when a malfunction occurs to the system and the system needs to be repaired) the tag information can be accessed only after unlocking all the necessary tags. Unlocking the tags typically requires security information (password, ID and other information). The tags are unlocked through executing a Security routine which requires presentation of a security password and other security information. Such security information is typically stored in tag memory. Where a hierarchy of tags is present, the hierarchy of passwords and security protocols can be distributed at each or any of the tag memory levels in the hierarchy and/or can be accumulated at the system level in the final element tag. In one embodiment, the final tag memory functions like a repository of keys to access the tag information at any level and stores all passwords and protocols necessary.

The Security routines used with tag stores are employed in a number of applications. One example previously described is to limit unwanted KILL or other actions and thereby provide safe operation avoiding inadvertent loss of information. Another example uses security to add a Validity Number at any stage of processing. The Validity Number is then used to validate the authenticity of a tag and the associated element.

Figure 17:
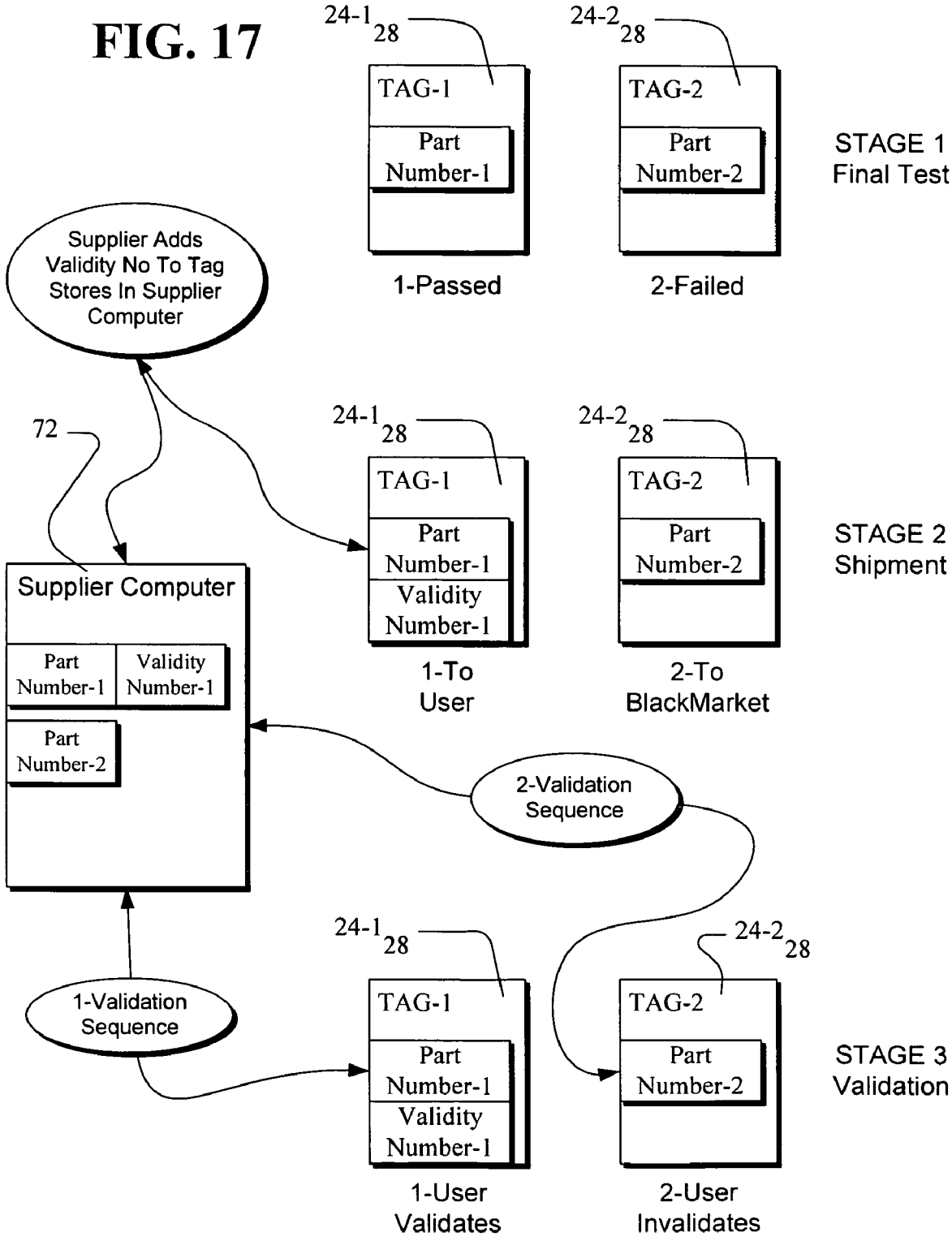
FIG. 17 depicts a flow diagram for authenticating tagged elements.

In FIG. 17, an example is shown for validating the authenticity of elements by storing Validity Numbers in tag stores. The TAG-1 24-1$_{28}$ and the TAG-2 24-2$_{28}$ are each attached to elements (not shown) that are typical of tags described in the present specification. STAGE 1 is assumed, for purposes of one example, as being a Final Test stage performed by a Supplier. For the example, the tag (TAG-1) 24-1$_{28}$ is assumed to pass the final test and the tag (TAG-2) 24-2$_{28}$ is assumed to fail the test. The Supplier after performing the Final Test then stores Validity Numbers into the tags where appropriate. For finished elements that pass the final test, a Validity Number is assigned and stored at a secure tag location (accessible only with password authentication) using a Security routine and a WRITE instruction. For finished elements that fail the final test, a Validity Number is not assigned (or is assigned with a value indicating the test failure) and the secure tag location is left empty or written with a failure indication. The Validity Number is generated in a typical example using the Part Number and an Encryption routine based upon the part number and known only by the Supplier and those authorized by the Supplier to know the Encryption routine. The Supplier also keeps a copy of the Validity Number in the Supplier computer 72 of FIG. 17 prior to shipment of the element having the passed tag 24-1$_{28}$ to a User. The User is, for example, a downstream manufacturer or reseller. The element with the failed tag 24-2$_{28}$ is not shipped by the Supplier. At times, failed goods or unauthorized copies of goods enter the black market and, for this reason and others, there is a need to be able to authenticate goods from a Supplier.

In FIG. 17, STAGE 2 the element with tag 24-1$_{28}$ is properly shipped to a User and in STAGE 3, the User wishes to validate tag 24-1$_{28}$. It is assumed that the User in STAGE 3 also has acquired an element with the unauthorized tag 24-2$_{28}$. One method of performing a validation sequence is performed on-line with a User, using a communicator 40 of the type described in FIG. 3, connected to the Supplier's computer such as management computer 41 in FIG. 1. With such connection established and with the tag 24-1$_{28}$ in the range of the communicator 40 of FIG. 3, the Validation routine is carried out as follows. The User's communicator 40 sends a request to the Supplier's computer 41 for validation of certain elements purportedly from the Supplier. The request can be manually or automatically initiated. Automatic initiation occurs, for example, when elements are first introduced into the inventory of the User which is detected, for example, after the Inventory routine is executed and new elements are found. The processor 42 sends the part numbers for the new elements to the Supplier's computer 41. The Supplier's computer then issues a READ instruction and reads the Validation Number for the tag 24-1$_{28}$. The Validation Number read from the tag 24-1$_{28}$ is communicated by the processor 42 to the management computer 41. The management computer 41 then decodes the Validity Number using the Part Number (and any other desired information available) to determine if the Validity Number is the correct one for the tag 24-1$_{28}$. If correct, the valid status together with time and date information is stored into the tag 24-1$_{28}$ and otherwise communicated to the User. In the case of the tag 24-2$_{28}$ the same Validation routine is repeated, but is this case, no valid Validity Number is detected and hence the invalid status together with time and date information is stored into the tag 24-1$_{28}$ and otherwise communicated to the User. Typically, the storage location for the Validity Number and access thereto is password protected so that only the Supplier has access to the Validity Number. If the Supplier wishes, the Supplier can share the password and/or the Validity Number encoding or decoding algorithm with the User or others under terms and conditions deemed suitable by the Supplier.

While use of Security routines and Validity Numbers has been described in connection with semiconductor elements and finished goods made therefrom, the routines are applicable to many fields. For example, the pharmaceutical field employs tag Security routines in the same manner as the semiconductor element example. Additionally, the pharmaceutical Supplier might wish to track the transit of goods distinguishing those that have only shipped within the domestic United States from those that have shipped outside the United States to another country, such as Canada, and then shipped back into the United States.

As another example, many consumer items such as famous watches, expensive apparel, jewelry and electronic equipment are the subject of counterfeiting. Communicators made available to US customs or other authority together with Security routines provided by Suppliers are effective to thwart and identify counterfeit goods. In one example, a encrypted Validity Numbers are stored in tags. Communicators made available to US customs or other authority have a decryption routine for decrypting encrypted Validity Numbers. If the decrypted Validity Number is in error, then the goods are presumed counterfeit.

As a still further example, terrorism involving contamination of goods can be better detected by requiring all goods in transit to have tags that are analyzed as to Security routines, Validity Numbers as well as transit locations for the entire history of the goods.

The use of a Validity Number can have many applications to thwart unauthorized use of finished elements with tags attached thereto. Any subsequent User of an element (such as a downstream manufacturer, board integrator, system integrator, distributor, reseller, seller or other) wishing to guarantee the authenticity of the element contacts the Supplier and after proper identification of the User, the finished element part number and any other information desired by the Supplier, the Supplier then authenticates the goods. Typically, if the User fails to authenticate finished elements from the Supplier, the Supplier's warranty or other obligations are voided. The authentication procedure is particularly useful in thwarting black market, counterfeit or other unauthorized transactions in unauthorized goods.

While the invention has been particularly shown and described with reference to preferred embodiments thereof it will be understood by those skilled in the art that various changes in form and details may be made therein without departing from the scope of the invention.

The invention claimed is:

1. A user product having the capacity for RF communication with an RF communicator comprising:

an element for providing user functions for the product, said element including semiconductor circuits manufactured with a semiconductor process to form element semiconductor circuits for providing said user functions; and a tag for providing tag operations through RF communication with the communicator, wherein said tag is affixed to and transportable with said element, and said tag comprises semiconductor circuits manufactured using the same semiconductor process for manufacturing said element semiconductor circuits to form tag semiconductor circuits for providing said tag operations, said semiconductor process encapsulating said tag semiconductor circuits and said element semiconductor circuits so as to impede tampering with said tag; and wherein tampering with said tag impedes normal tag operations by destroying RF communication of said tag or causing said tag to provide a logical state that indicates tampering, and tampering with said tag also damages said element and impedes normal user functions provided by said element.

2. The product of claim 1 wherein said tag has a low threshold value of mechanical stress whereby tampering causes said tag to break thereby preventing said tag from performing tag operations.

3. The product as in claim 2 wherein said tag has a low threshold value of mechanical stress as a function of the number of times the tag is stressed.

4. The product as in claim 2 wherein said tag has a low threshold value of mechanical stress as a function of the force applied to stress the tag.

5. The product as in claim 1 wherein said element semiconductor circuits and said tag semiconductor circuits are affixed to a common semiconductor base.

6. The product as in claim 1 wherein said element semiconductor circuits and said tag semiconductor circuits are affixed to a common circuit board.

7. A system having a plurality of products each having a capacity for RF communication with a communicator, each product comprising:

an element formed of components for providing user functions for the product, said element comprising element semiconductor circuits manufactured with a semiconductor process; and a tag for providing tag operations through RF communication with the communicator where said tag, is permanently affixed to and transportable with the element and comprises tag semiconductor circuits manufactured using the same semiconductor process for manufacturing said element semiconductor circuits, wherein said semiconductor process encapsulates said tag with said element so as to impede tampering with said tag, and wherein tampering with said tag impedes normal tag operations by destroying RF communication of said tag or causing said tag to provide a logical state that indicates tampering, and tampering with said tag also damages said element and impedes normal user functions provided by said element, communicates with said communicator using an instruction set, and executes commands in response to instructions received from said communicator.

8. The product of claim 1 wherein said element for providing user functions is independent of said tag and wherein said tag operations and said user functions are independent.

9. The product of claim 1 wherein said element for providing user functions is connected to said tag and wherein said tag operations interact with said user functions.

10. The product of claim 1 wherein said tag and said communicator communicate using an instruction set and wherein said tag executes commands issued by said communicator.

11. The product of claim 10 wherein said tag and said communicator communicate using a security routine for controlling access to said tag, said tag executing commands issued by said communicator only after passing a security check.

12. A system for RF communication comprising:

a plurality of products, each product including, an element formed of components for providing user functions for the product, said element comprising element semiconductor circuits manufactured with a semiconductor process; and one or more tags for providing tag operations through RF communication, each tag permanently affixed to and transportable with said element and comprising tag semiconductor circuits manufactured using the same semiconductor process for manufacturing said element semiconductor circuits, wherein said semiconductor process encapsulates said tag with said element so as to impede tampering with said tag, and wherein tampering with said tag impedes normal tag operations by destroying RF communication of said tag or causing said tag to provide a logical state that indicates tampering, and tampering with said tag also damages said element and impedes normal user functions provided by said element, and each tag having, a tag memory having storage locations for storing security information, a controller for accessing said tag memory to access said security information in response to a security routine, and an I/O unit for electronic communication with said controller and for RF communication; and a communicator having, an RF unit for RF communication with the tags, and a processor for executing tag program routines formed of instructions from a Tag Instruction Set where said instructions issue tag commands that cause said controller to access said tag, wherein one of said tag program routines comprises a security routine for executing a security protocol for controlling access to said tags.

13. The system of claim 12 wherein the tag receives an instruction from the communicator including a tag command and a received security string and wherein the controller compares the received security string with a stored security string stored in the tag memory and if the received security string matches the stored security string, the controller executes the tag command.

14. The system of claim 12 wherein another one of said tag program routines comprises a validation routine for validating the authenticity of said tag and wherein a Validity Number is stored in a secure tag location in said tag memory, said Validity Number being accessible only when the tag receives instructions associated with said validation routine from the communicator.

15. A user product having the capacity for RF communication with an RF communicator comprising:

an element formed of components for providing user functions for the product, said element comprising element semiconductor circuits manufactured with a semiconductor process; and a tag for providing tag operations through RF communication with said RF communicator, said tag being permanently affixed to and transportable with said element and comprising tag semiconductor circuits manufactured using the same semiconductor process for manufacturing said element semiconductor circuits, wherein said semiconductor process encapsulates said tag with said element so as to impede tampering with said tag, and wherein tampering with said tag impedes normal tag operations by destroying RF communication of said tag or causing said tag to provide a logical state that indicates tampering, and tampering with said tag also damages said element and impedes normal user functions provided by said element, each tag comprising:

a tag memory having storage locations for storing security information, a controller for accessing said tag memory to access said security information in response to a security routine, and an I/O unit for electronic communication with said controller and for RF communication, wherein said I/O unit receives an instruction associated with the security routine from said RF communicator, said controller executing a security protocol in response to the security routine for controlling access to said tag.

16. The product of claim 15 wherein said tag receives an instruction from the communicator including a tag command and a received security string and wherein the controller compares the received security string with a stored security string stored in the tag memory and if the received security string matches the stored security string, the controller executes the tag command.

17. The product of claim 15 wherein said tag receives instructions from the communicator associated with a validation routine for validating the authenticity of said tag and said controller accessing a Validity Number stored in a tag location in said tag memory in response to the instructions associated with the validation routine.

* * * * *